United States Patent [19]

Iwakura et al.

[11] Patent Number: 4,603,339

[45] Date of Patent: Jul. 29, 1986

[54] RECORDING MATERIAL

[75] Inventors: Ken Iwakura, Kanagawa; Takekatsu Sugiyama, Shizuoka, both of Japan

[73] Assignee: Fuji Photo Film Co., Ltd., Kanagawa, Japan

[21] Appl. No.: 700,159

[22] Filed: Feb. 11, 1985

[30] Foreign Application Priority Data

Feb. 9, 1984 [JP] Japan ..... 59-22622
Feb. 22, 1984 [JP] Japan ..... 59-31951

[51] Int. Cl.[4] ..... B41M 5/16; B41M 5/18; B41M 5/22

[52] U.S. Cl. ..... 346/216; 346/217; 346/225; 427/150

[58] Field of Search ..... 346/216, 225, 217; 427/150–152

[56] References Cited

FOREIGN PATENT DOCUMENTS 0059891 6/1980 Japan ..... 346/216
0129787 8/1982 Japan ..... 346/216
0167296 10/1982 Japan ..... 346/216
0188395 11/1982 Japan ..... 346/216
0203592 12/1982 Japan ..... 346/216

*Primary Examiner*—Bruce H. Hess
*Attorney, Agent, or Firm*—Sughrue, Mion, Zinn, Macpeak, and Seas

[57] ABSTRACT

A recording material is described, comprising an electron donating colorless dye and an electron accepting compound, wherein said electron accepting compound is represented by formula (I)

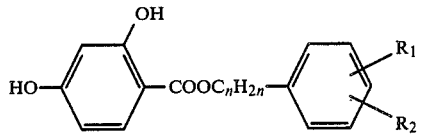

(I)

wherein n is an integer of 1 to 5, and $R_1$ and $R_2$ each represents a lower alkyl group, a lower alkoxy group, a hydrogen atom, a cyano group, or a hydrogen atom, provided that when n=1, either of $R_1$ and $R_2$ does not represent a hydrogen atom.

18 Claims, No Drawings

RECORDING MATERIAL

FIELD OF THE INVENTION

This invention relates to a recording material.

The recording material according to this invention is a recording sheet which utilizes a color developing reaction between an electron donating colorless dye and an electron accepting compound wherein a novel electron accepting compound is used as said electron accepting compound. The electron accepting compound employed in accordance with this invention is a very useful compound for pressure-sensitive recording material and heat-sensitive recording material which can be utilized in applications such as light and electricity sensitive recording sheet.

BACKGROUND OF THE INVENTION

The use of various phenol compounds as electron-accepting compounds in pressure-sensitive or heat-sensitive recording material has been described in U.S. Pat. Nos. 3,244,549 and 3,244,550, and British Pat. No. 1,135,540, etc. However, these phenol compounds cannot be considered fully satisfactory, in that none of them is capable of giving a desirably high color density when used in combination with electron donating colorless dyes.

Benzyl-p-hydroxybenzoate which is described in U.S. Pat. No. 4,399,188 is also unsatisfactory as a material for heat-sensitive recording material, for it does not provide sufficient resistance to moisture and heat of colored images, and benzyl-2,4-dihydroxybenzoate which is disclosed in Japanese Patent Application (OPI) No. 209590/83 (corresponding to British Pat. No. 2,122,763A) (the term "OPI" as used herein refers to a "published unexamined Japanese patent application") is also unsatisfactory as a material for heat-sensitive recording material, for it does not provide sufficient resistance to moisture and heat, and it also gives rise to a fogging problem.

SUMMARY OF THE INVENTION

The object of this invention is to provide a recording material wherein the combination of an electron donating colorless dye and an electron accepting compound yields an image of sufficient color density.

The above-mentioned object of this invention has now been accomplished by a recording material comprising an electron donating colorless dye and an electron accepting compound of formula (I)

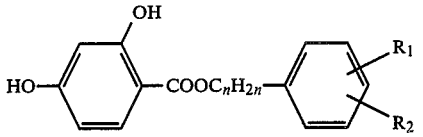

(I)

wherein n is an integer of 1 to 5, and $R_1$ and $R_2$ each represents a lower alkyl group, a lower alkoxy group, a halogen atom, a cyano group, or a hydrogen atom, provided that when n=1, $R_1$ or $R_2$ either does not represent a hydrogen atom.

DETAILED DESCRIPTION OF THE INVENTION

Referring in more detail to above formula (I), the substituents $R_1$ and $R_2$ may be located in any substitutable positions, but, when either of them is a hydrogen atom, the other is preferably in an ortho- or para-position, and most preferably in para-position, with respect to the group

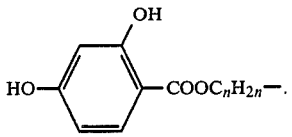

In cases where both $R_1$ and $R_2$ are other than a hydrogen atom, the ortho- and meta-positions with respect to the group

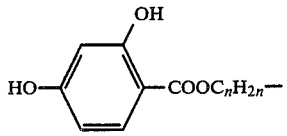

are their preferred positions.

Preferred species of said substituents $R_1$ and $R_2$ include an alkyl group containing from 1 to 5 carbon atoms, an alkoxy group containing from 1 to 5 carbon atoms, a chlorine atom, a bromine atom, a cyano group, and a hydrogen atom, except that when n=1, $R_1$ or $R_2$ either does not represent a hydrogen atom. Particularly desirable are an alkyl group containing from 1 to 3 carbon atoms, an alkoxy group containing from 1 to 3 carbon atoms, a chlorine atom, and a hydrogen atom.

In the above formula (I), a compound represented by formula (II) or (III) is preferred:

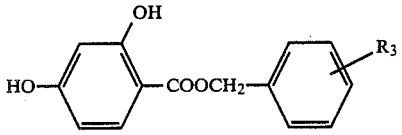

(II)

wherein $R_3$ is a lower alkyl group, a lower alkoxy group, a halogen atom or a cyano group, and

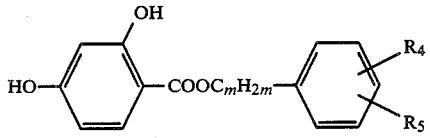

(III)

wherein $R_4$ and $R_5$ are the same or different, and each is a lower alkyl group, a lower alkoxy group, a halogen atom or a hydrogen atom, and m is an integer of 2 to 5.

Referring in more detail to the above formula (II), the substituent $R_3$ may be located in any substitutable position, but preferably in the ortho- or para-position, most preferably in the para-position, with respect to the group

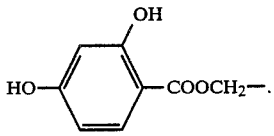

Preferred species of said substituent $R_3$ in formula (II) include an alkyl group containing from 1 to 5 carbon atoms, an alkoxy group containing from 1 to 5 carbon atoms, a chlorine atom, a bromine atom, and a cyano group. Particularly desirable are an alkyl group containing from 1 to 3 carbon atoms, an alkoxy group containing from 1 to 3 carbon atoms, and a chlorine atom.

Referring in more detail to above formula (III), the substituents $R_4$ and $R_5$ may be located in any substitutable positions, but, when either of them is a hydrogen atom, the other is preferably in an ortho- or para-position, and most preferably in para-position, with respect to the group

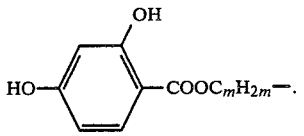

In cases where both $R_4$ and $R_5$ are other than a hydrogen atom, the orthoand meta-positions with respect to the group

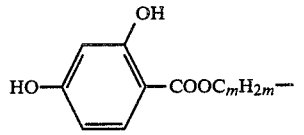

are their preferred positions. Further, m is preferably an integer of 2 or 3, more preferably an integer of 2.

Preferred species of said substituents $R_4$ and $R_5$ in formula (III) include an alkyl group containing from 1 to 5 carbon atoms, an alkoxy group containing from 1 to 5 carbon atoms, a chlorine atom, a bromine atom, and a hydrogen atom. Particularly desirable are an alkyl group containing from 1 to 3 carbon atoms, an alkoxy group containing from 1 to 3 carbon atoms, a chlorine atom, and a hydrogen atom.

For use in a heat-sensitive embodiment of the recording material according to this invention, the electron accepting compound according to this invention preferably has a melting point of at least 50° C., and particularly preferably a melting point between 70° C. and 150° C.

The electron accepting compound according to this invention has the following distinct properties:

(i) It gives a high density color image when used in combination with an electron donating colorless dye.

(ii) It is sparingly soluble in water.

(iii) It is not sublimable, but rather is stable.

(iv) It can be easily synthesized and made available in high purity and in good yield. The necessary starting materials are also inexpensive.

Specific examples of the electron accepting compounds for use in this invention are illustrated below, but the electron accepting compounds useful in this invention are not limited thereto.

(1) p-Methylbenzyl-2,4-dihydroxybenzoate,
(2) o-Methylbenzyl-2,4-dihydroxybenzoate,
(3) p-Isopropylbenzyl-2,4-dihydroxybenzoate,
(4) p-Methoxybenzyl-2,4-dihydroxybenzoate,
(5) p-Chlorobenzyl-2,4-dihydroxybenzoate,
(6) m-Chlorobenzyl-2,4-dihydroxybenzoate,
(7) o-Chlorobenzyl-2,4-dihydroxybenzoate,
(8) p-Ethylbenzyl-2,4-dihydroxybenzoate,
(9) β-Phenethyl-2,4-dihydroxybenzoate,
(10) β-p-Chlorophenylethyl-2,4-dihydroxybenzoate,
(11) β-p-Tolylethyl-2,4-dihydroxybenzoate,
(12) β-p-Methoxyphenylethyl-2,4-dihydroxybenzoate,
(13) α-Phenethyl-2,4-dihydroxybenzoate,
(14) α-p-Chlorophenylethyl-2,4-dihydroxybenzoate,
(15) γ-Phenylpropyl-2,4-dihydroxybenzoate,
(16) α-Methyl-α-phenethyl-2,4-dihydroxybenzoate,
(17) α-Methyl-γ-phenylpropyl-2,4-dihydroxybenzoate,
(18) β-(2,4-Dimethylphenyl)ethyl-2,4-dihydroxybenzoate, and
(19) β-(2,4-Dichlorophenyl)ethyl-2,4-dihydroxybenzoate.

These compounds may be used alone or in admixture, or in combination with other electron accepting compounds such as bisphenol A, benzyl 4-hydroxybenzoate, etc.

The electron donating colorless dye to be used in practicing the invention includes triarylmethane dyes, diphenylmethane dyes, xanthene dyes, thiazine dyes and spiropyran dyes, among others. Examples of such dyes include: triarylmethane dyes such as 3,3-bis(p-dimethylaminophenyl)-6-dimethylaminophthalide (i.e., crystal violet lactone, 3,3-bis(p-dimethylaminophenyl)phthalide, 3-(p-dimethylaminophenyl)-3-(1,3-dimethylindol-3-yl)-phthalide and 3-(p-dimethylaminophenyl)-3-(2-methylindol-3-yl)phthalide; diphenylmethane dyes such as 4,4'-bisdimethylaminobenzhydrin benzyl ether, N-halophenylleucoauramines and N-2,4,5-trichlorophenyl-leucoauramine; xanthene dyes such as rhodamine B anilinolactam, rhodamine (p-nitroanilino) lactam, rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-N-cyclohexyl-N-methylaminofluoran, 2-anilino-3-methyl-6-N-ethyl-N-isoamylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-anilino-3-methyl-6-dioctylaminofluoran, 2-p-chloroanilino-3-methyl-6-butylaminofluoran, 2-p-chloroanilino-3-ethoxy-6-N-ethyl-N-isoamylaminofluoran, 2-o-chloroanilino-6-p-butylanilinofluoran, 2-anilino-3-octadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-methyl-6-N-ethyl-N-butylaminofluoran, and 2-anilino-3-chloro-6-N-ethyl-N-isoamylaminofluoran; thiazine dyes such as benzoyl leuco methylene blue and p-nitrobenzyl leuco methylene blue; spiropyran dyes such as 3-methyl-spiro-dinaphthopyran, 3-ethyl-spiro-dinaphthopyran, 3,3'-dichloro-spirodinaphthopyran, 3-benzyl-spiro-dinaphthopyran, 3-methylnaphtho-(3-methoxybenzo)spiropyran and 3-propyl-spirodibenzopyran. These are used either singly or in admixture.

The following is a description of methods for producing the novel recording material according to this invention.

The pressure-sensitive recording material embodying the principle of this invention can be provided in a variety of forms such as those described in the prior art patent and other literature including U.S. Pat. Nos. 2,505,470, 2,505,471, 2,505,489, 2,548,366, 2,712,507, 2,730,456, 2,730,457 and 3,418,250. The simplest form may consist of two (or more) sheets containing an electron donating colorless dye and electron accepting compound according to this invention, respectively. Thus, the electron donating colorless dye or dyes are dissolved in a solvent which may, for example, be a synthetic oil such as alkylated naphthalene, alkylated diphenyl, alkylated diphenylmethane, alkylated terphenyl, etc., a vegetable oil such as cotton seed oil, castor oil, etc., an animal oil, a mineral oil, or a mixture of such oils. The solution thus prepared is dispersed in a binder or microencapsulated and the dispersion or microcapsules are coated on a support sheet such as paper, plastic sheet, resin-coated paper or the like to provide a color former sheet. On the other hand, said electron accepting compound or compounds, or a mixture thereof with other electron accepting compounds, is dispersed in a binder such as styrenebutadiene latex, polyvinyl alcohol or the like and the dispersion is coated on a support such as paper, plastic sheet, or resin-coated paper to provide a color developer sheet.

The relative proportions of said electron donating colorless dye component and electron accepting component depend on and are selected by reference to the desired coating thickness, type of pressure-sensitive copying sheet, microencapsulating method, and other conditions, and those skilled in the art can easily choose the optimum ratio.

Examples of said microencapsulating method include the method utilizing the coacervation of a hydrophilic colloid as taught by U.S. Pat. Nos. 2,800,457 and 2,800,458, and the interfacial polymerization method described in British Pat. Nos. 867,797, 950,443, 989,264, and 1,091,076.

To manufacture a heat-sensitive recording material, an electron donating colorless dye and the electron accepting compound according to this invention are mixed with a solution or dispersion of a binder in a solvent or dispersing medium. If desired, a heat-fusible substance is finely comminuted and admixed. Moreover, an oil-absorbent pigment such as kaolin, calcined kaoline, talc, agalmatolite, diatomaceous earth, calcium carbonate, aluminum hydroxide, magnesium hydroxide, magnesium carbonate, titanium oxide, barium carbonate, urea-formaldehyde filler, cellulose filler, etc., is added to prepare a coating dispersion. If desired, there may further be incorporated a paraffin wax emulsion, latex binder, sensitizer, metal soap, antioxidant, ultraviolet absorber, image retention improving agent, etc.

This coating dispersion is applied to a support such as paper, plastic sheet, resin-coated paper or the like, followed by drying. In preparing the coating dispersion, all the components may be simultaneously milled together or may be milled and dispersed in suitable groups and then combined.

The coating dispersion may be incorporated into the support sheet.

The proportions of components used for forming a heat-sensitive recording material are 1 weight part of the electron donating colorless dye, from 0.5 to 10 weight parts of the electron accepting compound, from 0 to 30 weight parts of heat-fusible substance, and from 0 to 15 weight parts of pigment, from 1 to 15 weight parts of binder, and the preferred proportion of the color former and color developer is from 1:5 to 2:1 (weight ratio).

The electron donating colorless dyes may be used either alone or as a mixture of two or more species. The most desirable dispersing medium or solvent is water.

Examples of the binder that is employed in the practice of this invention include styrene-butadiene copolymer, alkyd resin, acrylamide copolymer, vinyl chloride-vinyl acetate copolymer, styrene-maleic anhydride copolymer, synthetic rubber, gum arabic, polyvinyl alcohol, hydroxyethyl cellulose and carboxymethyl cellulose, etc.

Particularly preferable, from the standpoint of compatibility with the dispersing medium or solvent, are water-soluble binders such as gum arabic, polyvinyl alcohol, hydroxyethyl cellulose, carboxymethyl cellulose, etc.

As the heat-fusible material mentioned hereinbefore, there may be used, if desired, erucic acid, stearic acid, behenic acid, palmitic acid, stearamide, behenamide, stearic acid anilide, stearic acid toluidide, N-myristoyl-p-anisidine, N-myristoyl-p-phenetidine, 1-methoxycarbonyl-4-N-stearylcarbamoylbenzene, N-octadecylurea, N-hexadecylurea, N,N'-didodecylurea, phenylcarbamoyloxydodecane, p-t-butylphenol phenoxyacetate, p-phenylphenol-p-chlorophenoxyacetate, 4,4'-isopropylidenebis(methoxybenzene), β-phenylethyl-p-phenylphenyl ether, 2-p-chlorobenzyloxynaphthalene, 2-benzyloxynaphthalene, 1-benzyloxynaphthalene, 2-phenoxyacetyloxynaphthalene, diphenyl phthalate, phenyl 1-hydroxy-2-naphthoate, 2-benzoyloxynaphthalene, benzyl p-benzyloxybenzoate, hydroquinone acetate, and so forth.

Each of these substances is a colorless solid at room temperature and has a well-defined melting point at typical copying temperatures, i.e., in the vicinity of from 70° to 160° C.

As examples of said wax, there may be mentioned paraffin wax, carnauba wax, microcrystalline wax, polyethylene wax, etc., as well as higher fatty acid amides such as stearamide, ethylenebisstearamide, etc., and higher fatty acid esters.

The metal soap is exemplified by polyvalent metal salts of higher fatty acids such as zinc stearate, aluminum stearate, calcium stearate, zinc oleate, etc.

The image retention improving agent is exemplified by substituted phenols, i.e., substituted by at least one alkyl group in the 2- or 6-position, and derivatives thereof. Particularly preferred is a phenol substituted by tert-butyl in at least one of its 2- and 6-positions or a derivative thereof. Also particularly desirable are compounds having a plurality of phenol groups, preferably 2 or 3 phenol groups, within the molecule. The following are examples of such compounds:

Glycol bis[3,3-bis(4'-hydroxy-3'-tert-butylphenyl)-butanoate],

Glycol bis[3,3-bis(4'-hydroxy-3',4'-di-tert-butylphenyl)-butanoate],

Glycol bis[3,3-bis(2'-methyl-4'-hydroxy-5'-tertbutylphenyl)butanoate], 1,1,3-Tris(2-methyl-4-hydroxy-5-tert-butylphenyl)butane, 4,4'-Thiobis(3-methyl-6-tert-butylphenol), 4,4'-Thiobis(2-methyl-6-tert-butylphenol), 2,2'-Thiobis(4-methyl-6-tert-butylphenol),
2,2'-Methylenebis(4-methyl-6-tert-butylphenol),
2,2'-Methylenebis(4-ethyl-6-tert-butylphenol),
4,4'-Butylidenebis(3-methyl-6-tert-butylphenol),
4,4'-Methylenebis(2,6-di-tert-butylphenol),
2-tert-Butyl-4-tert-butoxyphenol,
2,2-Dimethyl-4-isopropyl-7-tert-butyl-6-chromanol,
2,2-Dimethyl-6-t-butyl-5-benzofuranol, and
4-{[4,6-Bis(tert-butylthio)-s-triazin-2-yl]amino}-2,6-di-tert-butylphenol.

The amount of such compound or compounds used is typically from 5 to 200 weight %, and preferably from 20 to 100 weight %, relative to the electron accepting compound.

This invention is described below in further detail by way of examples, but it is to be understood, however, that the invention is by no means limited to the specific examples.

EXAMPLE 1

(1) Preparation of a Color Former Sheet

In 30 g of alkylated naphthalene was dissolved 1 g of the electron donating colorless dye 2-anilino-3-methyl-6-diethylaminofluoran. This solution was added, with vigorous stirring, to 50 g of an aqueous solution of 6 g of gelatin and 4 g of gum arabic to prepare an emulsion comprising oil droplets from 1μ to 10μ in diameter, followed by addition of 250 g of water. The pH of the emulsion was brought to pH about 4 by adding acetic acid thereto in small portions, to thereby cause coacervation. By this procedure walls were formed around the oil droplets by gelatin and gum arabic. After addition of formalin (formaldehyde), the pH of the system was increased to a pH of 9, to thereby cure the walls.

The resulting dispersion of microcapsules was coated on a sheet of paper to provide a color former sheet.

(2) Preparation of Color Developer Sheet

In 200 g of a 5% aqueous solution of polyvinyl alcohol was dispersed 20 g of the electron accepting compound p-methylbenzyl-2,4-dihydroxybenzoate (m.p. 103° to 110° C.), followed by addition of 20 g of kaolin (Georgia kaolin). The mixture was well dispersed to provide coating dispersion. This dispersion was coated on a sheet of paper and dried to provide a color developer sheet.

Further, a color developer sheet was prepared in the same procedure as described above except that β-phenylethyl-2,4-dihydroxybenzoate was used in place of p-methylbenzyl-2,4-dihydroxybenzoate.

This color former sheet and the each color developer sheet prepared above were brought into contact under pressure or impact, respectively, whereupon a black image was instantly produced. The each image had a high density and a good resistance to light and heat.

EXAMPLE 2

In a ball mill, 5 g of the electron donating colorless dye 2-anilino-3-chloro-6-diethylaminofluoran was dispersed in 50 g of a 5% aqueous solution of polyvinyl alcohol (degree of saponification 99%, degree of polymerization 1,000) for one full day. Similarly, in a ball mill, 10 g of the electron accepting compound p-methylbenzyl-2,4-dihydroxybenzoate was dispersed in 100 g of a 5% aqueous solution of polyvinyl alcohol for one full day. These two dispersions were admixed, and then 20 g of kaolin (Georgia kaolin) was further added and well dispersed, followed further by addition of 5 g of 50% paraffin wax emulsion (Chukyo Oil and Fat Co., Ltd., Celosol ® #428) to provide coating dispersion.

This dispersion was caoted on a support paper sheet weighing 50 g/m$^2$ in a coating amount of 6 g (nonvolatile matter)/m$^2$, and dried at 60° C. for 1 minute to provide a coated paper sheet.

EXAMPLE 3

The procedure of Example 2 was repeated except that 10 g of p-chlorobenzyl-2,4-dihydroxybenzoate (m.p. 138°-140° C.) was used in lieu of the electron accepting compound mentioned in Example 2 to provide a coated paper sheet.

EXAMPLE 4

The procedure of Example 2 was repeated except that 10 g of p-isopropylbenzyl-2,4-dihydroxybenzoate was used in lieu of the electron accepting compound mentioned in Example 2 to provide a coated paper sheet.

EXAMPLE 5

The procedure of Example 2 was repeated except that 10 g of o-chlorobenzyl-2,4-dihydroxybenzoate was used in lieu of the electron accepting compound mentioned in Example 2 to provide a coated paper sheet.

EXAMPLE 6

The procedure of Example 2 was repeated except that 10 g of β-phenylethyl-2,4-dihydroxybenzoate was used in lieu of the electron accepting compound mentioned in Example 2 to provide a coated paper sheet.

EXAMPLE 7

The procedure of Example 2 was repeated except that 10 g of α-phenylethyl-2,4-dihydroxybenzoate was used in lieu of the electron accepting compound mentioned in Example 2 to provide a coated paper sheet.

COMPARATIVE EXAMPLE 1

The procedure of Example 2 was repeated except that 10 g of 2,2-bis(4-hydroxyphenyl)propane was used in lieu of the electron accepting compound of Example 2 to provide a coated paper sheet.

COMPARATIVE EXAMPLE 2

The procedure of Example 2 was repeated except that 10 g of benzyl-2,4-dihydroxybenzoate was used in lieu of the electron accepting compound of Example 2 to provide a coated paper sheet.

COMPARATIVE EXAMPLE 3

The procedure of Example 2 was repeated except that 10 g of benzyl-p-hydroxybenzoate was used in lieu of the electron accepting compound of Example 2 to provide a coated paper sheet.

COMPARATIVE TEST

Comparative tests of heat recording papers obtained in above Examples and Comparative Examples were carried out as follows:

(1) Fog and Coloring Property:

Recording was performed by providing an energy of 40 mJ/mm$^2$ by the facsimile (Type EF-22 made by Matsushita Denso Co., Ltd.) to a recording element. Fog (density of background before recording) and colored image density after recording (initial density) were measured by means of Macbeth RD-514 type reflective densitometer (visual filter was used).

(2) Moisture and Heat Resistance:

After the recording sheet obtained at the coloring property test was allowed to stand at 40° C. in an atmosphere of RH 90% for for one full day, fog (density of non-colored portion) and color image density were measured.

The remaining ratio of the color image was calculated using the following equation.

$$\frac{\text{Density after the Test of Moisture and Heat Resistance}}{\text{Initial Density}} \times 100\ (\%)$$

The results of the comparative test are shown in Table 1.

TABLE 1

| Sample | Fog and Coloring Property | | Moisture and Heat Resistance | |
|---|---|---|---|---|
| | Fog | Density | Fog | Remaining Ratio |
| Heat-Sensitive Recording Sheet Obtained in Example 2 | 0.07 | 1.03 | 0.09 | 90 |
| Heat-Sensitive Recording Sheet Obtained in Example 3 | 0.06 | 0.93 | 0.07 | 85 |
| Heat-Sensitive Recording Sheet Obtained in Example 4 | 0.06 | 0.95 | 0.07 | 85 |
| Heat-Sensitive Recording Sheet Obtained in Example 5 | 0.07 | 1.00 | 0.09 | 89 |
| Heat-Sensitive Recording Sheet Obtained in Example 6 | 0.06 | 1.05 | 0.06 | 92 |
| Heat-Sensitive Recording Sheet Obtained in Example 7 | 0.06 | 0.95 | 0.08 | 87 |
| Heat-Sensitive Recording Sheet Obtained in Comparative Example 1 | 0.07 | 0.58 | 0.09 | 98 |
| Heat-Sensitive Recording Sheet Obtained in Comparative Example 2 | 0.10 | 1.05 | 0.81 | 95 |
| Heat-Sensitive Recording sheet Obtained in Comparative Example 3 | 0.07 | 1.00 | 0.08 | 21 |

The above Table represents that the recording sheet using the electron accepting compound of the present invention is superior to the reference recording sheet with respect to the color density and the moisture and heat resistance.

EXAMPLE 8

In a 300 ml ball mill, 20 g of 2-anilino-3-methyl-6-N-ethyl-N-isoamylaminofluoran was dispersed in 100 g of a 10% aqueous solution of polyvinyl alcohol (degree of saponification 98%, degree of polymerization 500) for one full day to give a dispersion (A). Similarly, in a 300 ml ball mill, 10 g of p-methylbenzyl-2,4-dihydroxybenzoate was dispersed in 100 g of 10% aqueous PVA for one full day to provide a dispersion (B). Further, 20 g of glycol bis[3,3-bis(4'-hydroxy-3'-tertbutylphenyl)-butanoate] and 100 g of 10% aqueous PVA were similarly treated in a 300 ml ball mill to prepare a dispersion (C).

The above dispersions (A), (B) and (C) were mixed in a weight ratio of 3:20:5, and 50 g of finely divided calcium carbonate was added to 200 g of the mixture. The whole mixture was dispersed well to give a coating dispersion.

This heat-sensitive recording material coating dispersion was applied with an air knife to a paper sheet support weighing 50 g/m$^2$ in a coating amount of 6 g (non-volatile)/m$^2$, and dried at 50° C. for 2 minutes to produce a heat-sensitive recording sheet.

EXAMPLE 9

The procedure of Example 8 was repeated except that 10 g of γ-phenylpropyl-2,4-dihydroxybenzoate was used in lieu of 10 g of p-methylbenzyl-2,4-dihydroxybenzoate of Example 8 to produce a heat-sensitive recording sheet.

When these coated paper sheets obtained in Examples 8 and 9 were exposed to the developing temperature of the facsimile (Type EF-22 made by Matsushita Denso Co., Ltd.), a black print was obtained. The retentivity of this image was very satisfactory.

While the invention has been described in detail and with reference to specific embodiments thereof, it will be apparent to one skilled in the art that various changes and modifications can be made therein without departing from the spirit and scope thereof.

What is claimed is:

1. A recording material comprising a substrate containing an electron donating colorless dye and electron accepting compound, wherein said electron accepting compound is represented by formula (I)

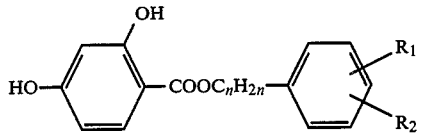

(I)

wherein n is an integer of 1 to 5, and $R_1$ and $R_2$ each represents a lower alkyl group, a lower alkoxy group, a halogen atom, a cyano group, or a hydrogen atom, provided that when n=1, $R_1$ or $R_2$ either does not represent a hydrogen atom.

2. A recording material as in claim 1, wherein said recording material is used as a pressure-sensitive recording material.

3. A recording material as in claim 1, wherein said recording material is used as a heat-sensitive recording material.

4. A recording material as in claim 3, wherein the electron accepting compound is used in an amount of from 0.5 to 10 parts by weight per 1 part by weight of the electron donating colorless dye.

5. A recording material as in claim 1, wherein said electron accepting compound is represented by formula (II)

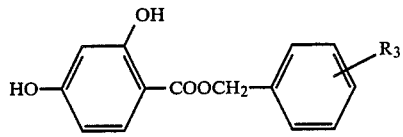

(II)

wherein $R_3$ represents a lower alkyl group, a lower alkoxy group, a halogen atom or a cyano group.

6. A recording material as in claim 5, wherein $R_3$ represents an alkyl group containing from 1 to 5 carbon atoms, an alkoxy group containing from 1 to 5 carbon atoms, a chlorine atom, a bromine atom, or a cyano group.

7. A recording material as in claim 5, wherein $R_3$ is located in an ortho- or para-position with respect to the group

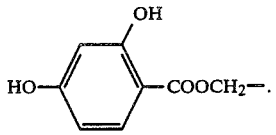

8. A recording material as in claim 5, wherein said recording material is used as a pressure-sensitive recording material.

9. A recording material as in claim 5, wherein said recording material is used as a heat-sensitive recording material.

10. A recording material as in claim 9, wherein the electron accepting compound is used in an amount of from 0.5 to 10 parts by weight per 1 part by weight of the electron donating colorless dye.

11. A recording material as in claim 1, wherein said electron accepting compound is represented by formula (III)

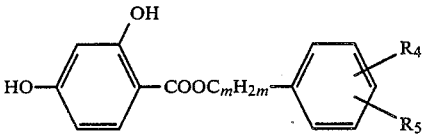

(III)

wherein m is an integer of 2 to 5, and $R_4$ and $R_5$ each represents a lower alkyl group, a lower alkoxy group, a halogen atom, or a hydrogen atom.

12. A recording material as in claim 11, wherein $R_4$ and $R_5$ each represents an alkyl group containing from 1 to 5 carbon atoms, an alkoxy group containing from 1 to 5 carbon atoms, a chlorine atom, a bromine atom, or a hydrogen atom.

13. A recording material as in claim 11, wherein m is an integer of 2 or 3.

14. A recording material as in claim 11, wherein when either or $R_4$ and $R_5$ is a hydrogen atom, the other is located in an ortho- or para-position with respect to the group

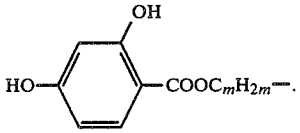

15. A recording material as in claim 11, wherein when both $R_4$ and $R_5$ are other than a hydrogen atom, $R_4$ and $R_5$ are located in the ortho- or meta-position with respect to the group

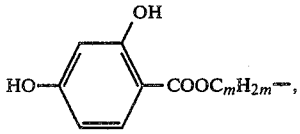

respectively.

16. A recording material as in claim 11, wherein said recording material is used as a pressure-sensitive recording material.

17. A recording material as in claim 11, wherein said recording material is used as a heat-sensitive recording material.

18. A recording material as in claim 17, wherein the electron accepting compound is used in an amount of from 0.5 to 10 parts by weight per 1 part by weight of the electron donating colorless dye.

* * * * *